US006257457B1

(12) United States Patent
Oechsel

(10) Patent No.: US 6,257,457 B1
(45) Date of Patent: Jul. 10, 2001

(54) DEVICE FOR SPRAYING A FLUID PRODUCT, SUCH AS A DOUBLE DOSE DISPENSER

(75) Inventor: François Oechsel, Louviers (FR)

(73) Assignee: Valois S.A., Le Neubourg (FR)

( * ) Notice: Subject to any disclaimer, the term of this patent is extended or adjusted under 35 U.S.C. 154(b) by 0 days.

(21) Appl. No.: 09/381,811

(22) PCT Filed: Mar. 16, 1998

(86) PCT No.: PCT/FR98/00522

§ 371 Date: Oct. 26, 1999

§ 102(e) Date: Oct. 26, 1999

(87) PCT Pub. No.: WO98/42447

PCT Pub. Date: Oct. 1, 1998

(30) Foreign Application Priority Data

Mar. 26, 1997 (FR) ..... 97/03703

(51) Int. Cl.[7] ..... B65D 88/54
(52) U.S. Cl. ..... 222/320; 222/386; 222/309
(58) Field of Search ..... 222/43, 309, 319, 222/320, 321.1, 321.6, 384, 321.2

(56) References Cited

U.S. PATENT DOCUMENTS 4,445,626 * 5/1984 Steffen et al. ..... 222/309
5,427,280 * 6/1995 Fuchs ..... 222/321.1
5,511,698 * 4/1996 Solignac ..... 222/321.1

FOREIGN PATENT DOCUMENTS 311 863 4/1989 (EP) .
452728 10/1991 (EP) .
5546 607 6/1993 (EP) .

* cited by examiner

*Primary Examiner*—Kevin Shaver
*Assistant Examiner*—Thach H. Bui
(74) *Attorney, Agent, or Firm*—Sughrue, Mion, Zinn, Macpeak & Seas, PLLC

(57) ABSTRACT

A device for spraying fluid, the device comprising a tank (11) containing a plurality of doses of fluid, a cylindrical base (14) receiving said tank (11), a dispenser member such as a pump, a manual actuator element (20), fractioning means (16) co-operating with said actuator element (20) to fraction the content of the tank (11) into at least two doses, and energy-accumulator means (12) co-operating, during actuation, with said manual actuator element (20) to accumulate energy in the hand of the user so as to guarantee proper atomization of the entire dose of fluid on each actuation, the device being characterized in that said base (14), said fractioning means (16), and said energy-accumulator means (12) form integral portions of a common one-piece block (10).

15 Claims, 5 Drawing Sheets

10

DEVICE FOR SPRAYING A FLUID PRODUCT, SUCH AS A DOUBLE DOSE DISPENSER

The present invention relates to a device for spraying fluids, and more particularly to such a spray device designed to deliver at least two doses of the fluid.

Devices of that kind give rise to several problems. Thus, one problem which arises is that of obtaining perfect atomization of the entire dose when the device is actuated. Another problem is that of ensuring that the content of the tank is fractioned in simple and reliable manner so as to be able to transform the device into a two-dose dispenser.

Document WO 93/02804 deals with these problems in an attempt to solve them. That document discloses a device such as a two-dose dispenser, comprising a tank mounted on a base and a pusher for actuating the apparatus. A portion of the pusher co-operates with a split ring placed in a groove formed in the outer wall of the tank so that in order to be able to dispense the first dose, it is necessary to build up a certain amount of force in the hand of the user until the split ring leaves its groove. In order to fraction the content of the tank into two doses, the device of document WO 93/02804 provides for forming a second groove in the outer wall of the tank and for placing a second split ring therein such that after the device has been actuated to expel the first dose, the assembly comprising the pusher plus the first split ring is stopped by the second ring located in said second groove. Thereafter, in order to spray the second dose, it is again necessary to build up a certain amount of force in order to be able to cause the second split ring to leave its groove and thus cause the second dose to be dispensed. That device operates in satisfactory manner but can nevertheless present certain drawbacks. Thus, since only a small amount of fluid is contained in the tank, a main object is to keep the cost of said spray device as low as possible so as to avoid having a negative influence on the final sale price of the device. Unfortunately, the device disclosed in document WO 93/02804 has various different component parts which are necessary to perform the energy-accumulating function and the dose-fractioning function. The manufacture and assembly of those various component parts can therefore be relatively expensive. Furthermore, because of the presence of two peripheral grooves in the outer surface of the tank, it is practically impossible to make the tank and the base as a single piece, since said grooves are situated in the hollow annular space defined between the tank and the base. In addition, the use of moving means for performing the energy-accumulating function can give rise to the risk of faulty operation in the event of said split rings breaking or jamming.

Document EP-0 546 607 discloses a single-dose dispenser having a peripheral groove in the inner wall of the body which co-operates with a peripheral rib on the outer wall of the tank so as to prevent the device being actuated accidentally. The drawback of that kind of device is the difficulty in making a mold that is simple and of low cost. The groove in the inner wall requires the use of an undercut and thus a mold that is relatively complicated.

Document EP-0 311 863 discloses a two-dose dispenser having dose-fractioning means which are disposed on a part that is engaged on the body and that co-operates with the tank. It does not have energy-accumulating means and it requires the use of an additional part, with the molding of said part also suffering from the same drawbacks as those described above, i.e. a mold that is complicated and expensive.

An object of the present invention is to provide such a device for spraying fluids which does not have the above-mentioned drawbacks.

Thus, an object of the present invention is to provide a device for spraying fluids that comprises a minimum number of component parts.

Another object of the present invention is to provide such a device making it possible to achieve reliable fractioning while guaranteeing a manufacturing cost, and in particular for molding and for assembly, that is as small as possible.

Another object of the present invention is to provide a device for spraying fluids, such as a two-dose dispenser, that is capable of guaranteeing perfect atomization of the entirety of each dose, while still being simple to fabricate, assemble, and use, and to do so at the smallest possible cost.

The present invention thus provides a device for spraying fluid, the device comprising a tank containing a plurality of doses of fluid, a cylindrical base receiving said tank, a dispenser member such as a pump, a manual actuator element, fractioning means co-operating with said actuator element to fraction the content of the tank into at least two doses, and energy-accumulator means co-operating, during actuation, with said manual actuator element to accumulate energy in the hand of the user so as to guarantee proper atomization of the entire dose of fluid on each actuation, the device being characterized in that said base, said fractioning means, and said energy-accumulator means form integral portions of a common one-piece block.

Preferably, said tank is integrally formed with said one-piece block.

Preferably, the dispenser device comprises indexing means co-operating with said manual actuator element selectively to allow or prevent actuation of the device, in which said indexing means are integrally formed with said one-piece block.

Advantageously, said indexing means are formed by one or more thickenings provided on a portion of an inner surface of said one-piece block and co-operating, in a first position of the actuator element, with one or more tabs projecting into the inside of the actuator element to prevent actuation of the device, said actuator element being movable in rotation relative to said one-piece block into a second position in which said tabs no longer co-operate with said thickenings, thereby enabling the device to be actuated.

Preferably, said energy-accumulator means co-operate with said actuator element by deforming it elastically when a predetermined minimum force is exerted thereon.

Advantageously, said energy-accumulator means are studs formed on the outer surface of said one-piece block, which studs co-operate with corresponding shoulders provided on the inner surface of the actuator element.

Advantageously, said fractioning means are formed by thickenings forming at least one axially-directed step with the thickenings acting as indexing means.

In a preferred embodiment of the present invention, the dispenser device is a two-dose dispenser adapted to dispense two doses of fluid, said actuator element being rotatably mounted on said one-piece block which comprises:

- first indexing means formed by one or more thickenings extending over a first portion of the inner peripheral surface of the base and co-operating, in a first position of the actuator element, with one or more axial tabs projecting into the actuator element to prevent the first dose being dispensed;
- first energy-accumulator means formed by one or more studs projecting from the outer surface of said base and co-operating, after a first rotation of the actuator element into a second position in which said first indexing means no longer co-operate with the actuator element, with one or more shoulders provided on the inner surface of the actuator element, thereby accumulating energy in the hand of the user during actuation of the device, said shoulders passing over said studs only after a predetermined minimum force has been applied, thereby enabling the actuator element to move relative to the one-piece block, and thus to cause the first dose to be dispensed;

fractioning means formed by one or more thickenings extending over a second portion of the inner peripheral surface of the base and co-operating with said axial tab(s) of the actuator element after the first dose has been dispensed to prevent additional axial displacement of the actuator element over the one-piece block, thereby fractioning the content of the tank into two doses, such that said fractioning means act simultaneously as second indexing means; and second energy-accumulator means formed by one or more studs projecting from the outer surface of the base and co-operating, after a second rotation of the actuator element into a third position in which said second indexing means no longer co-operate with the actuator element, with said shoulder(s) of the actuator element to accumulate energy in the hand of the user, allowing the second dose to be dispensed only after a predetermined minimum force has been applied.

Preferably, each of said first and second energy-accumulator means comprises a pair of diametrically-opposite projecting studs, the two pairs of studs being axially and circumferentially offset relative to each other on the outer surface of said one-piece block.

Advantageously, in said first position of the actuator element, said shoulder(s) of the actuator element co-operate, e.g. by snap-fastening, with fastening means provided on the top peripheral edge of said one-piece piece to hold said actuator element on said one-piece block.

Preferably, said one-piece block includes, on an outer surface: first rotary abutment means co-operating with said actuator element to define said first position of the actuator element; and second rotary abutment means co-operating with the actuator element to define said second position of the actuator element; and third rotary abutment means co-operating with the actuator element to define said third position of the actuator element.

Other characteristics and advantages of the present invention appear from the following detailed description of a preferred embodiment of the present invention, given by way of non-limiting example with reference to the accompanying drawings, in which.

Figure 3A:
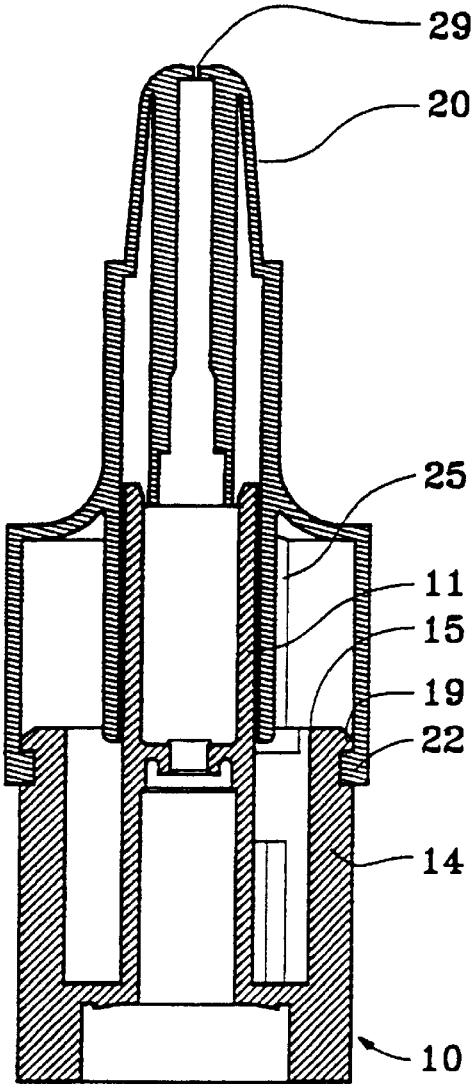
Figure 3B:
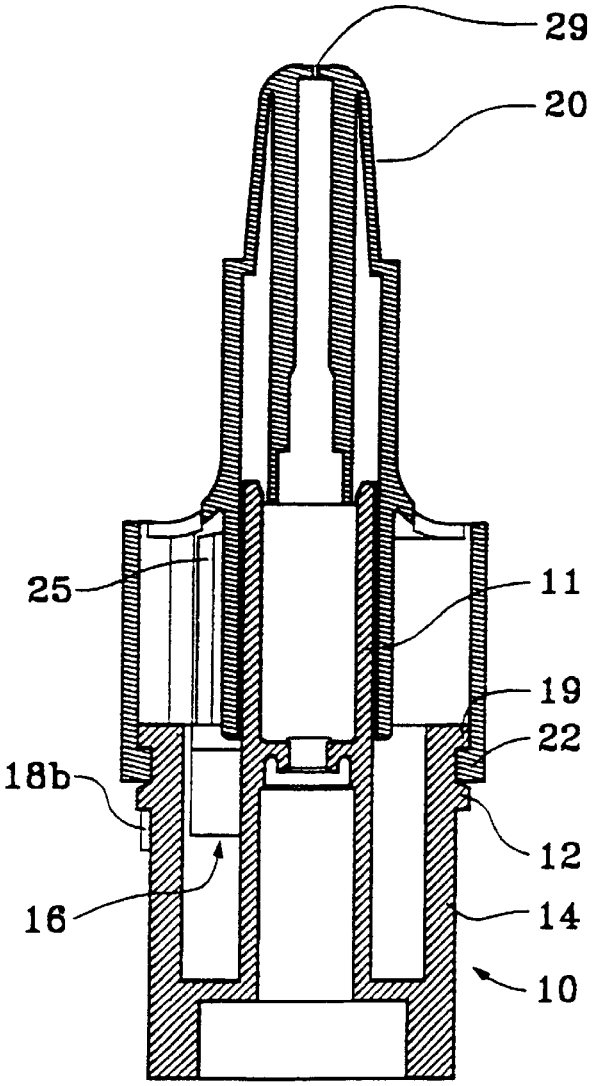
Figure 4:
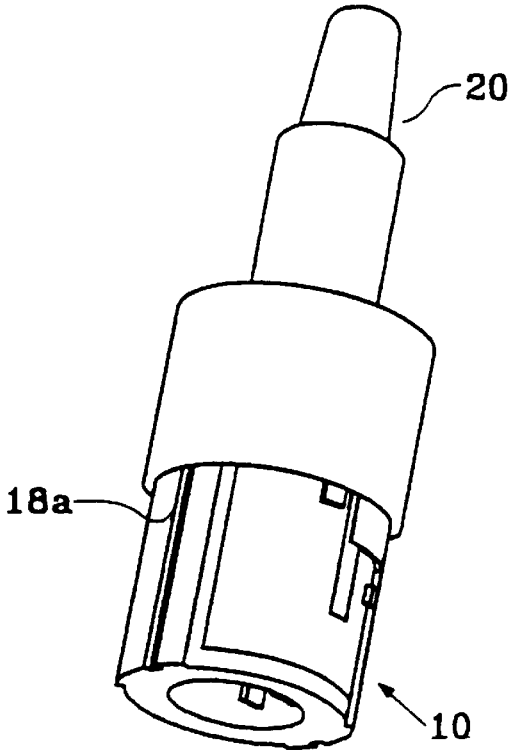
Figure 5:
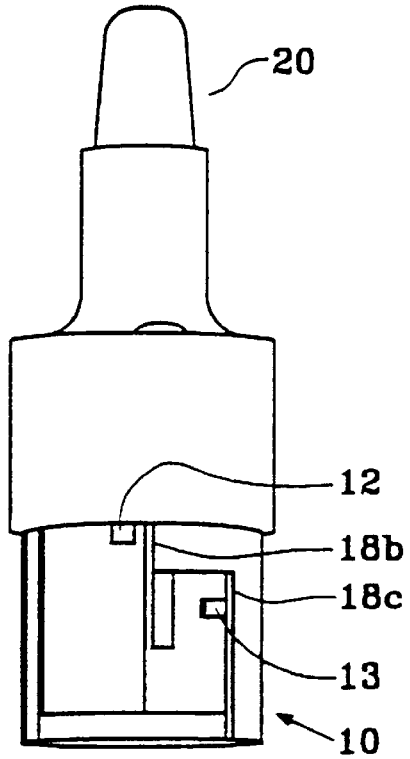
Figure 6:
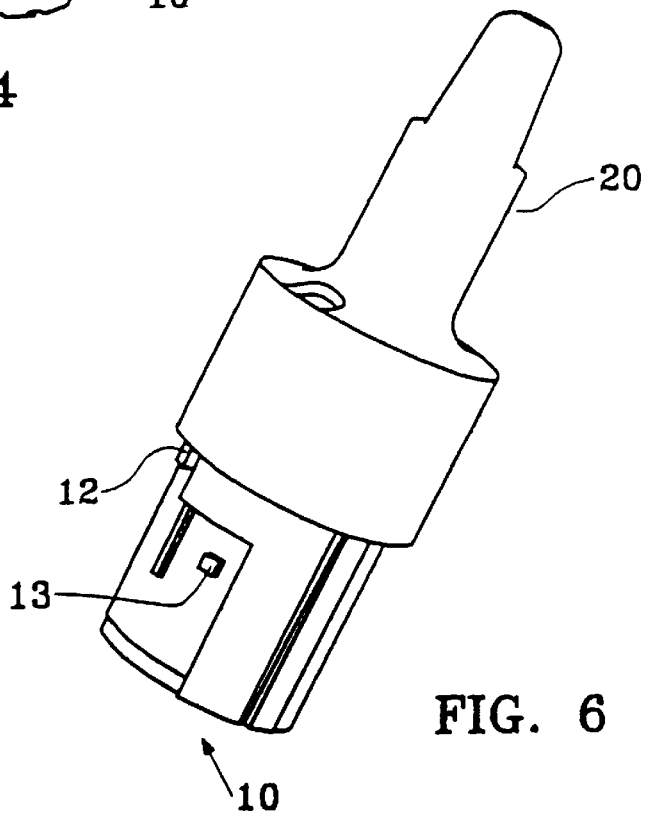
Figure 7A:
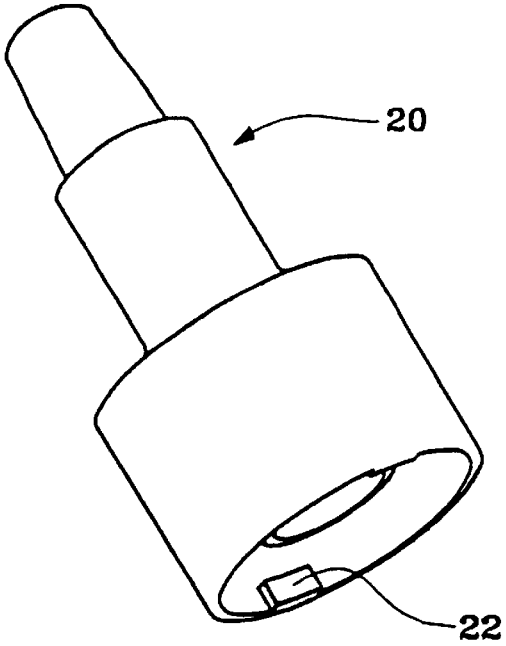
Figure 7B:
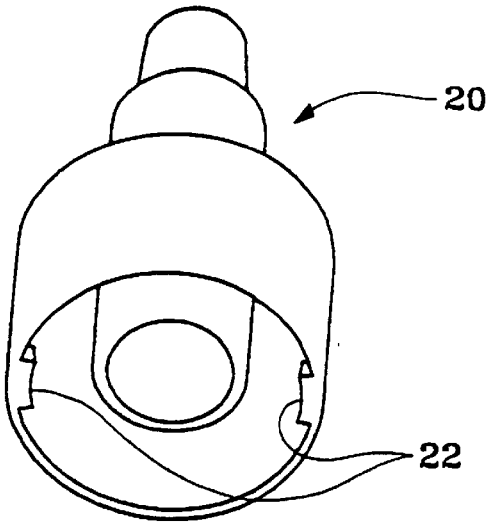
Figure 8:
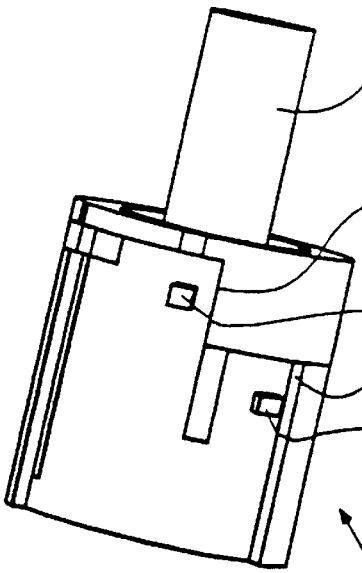
Figure 9:
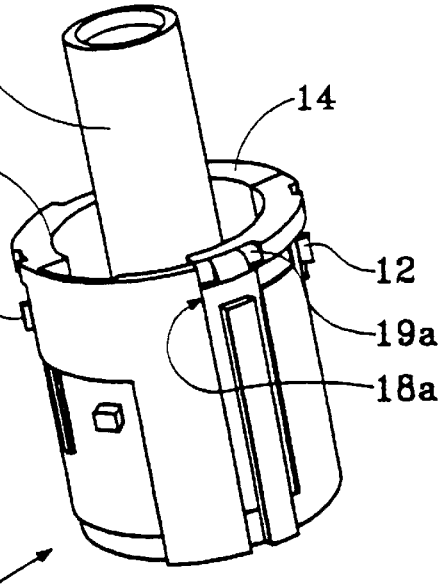

FIGS. 3*a* and 3*b* are diagrammatic vertical section views showing the device constituting a preferred embodiment of the present invention, respectively in a rest position that prevents actuation, and in a ready position from which the first dose can be dispensed;

FIGS. 4, 5, and 6 are diagrammatic perspective views of the dispenser device constituting a preferred embodiment of the invention;

FIGS. 7*a* and 7*b* are diagrammatic perspective views of the actuator element; and FIGS. 8 and 9 are diagrammatic perspective views of the one-piece block.

Figure 1:
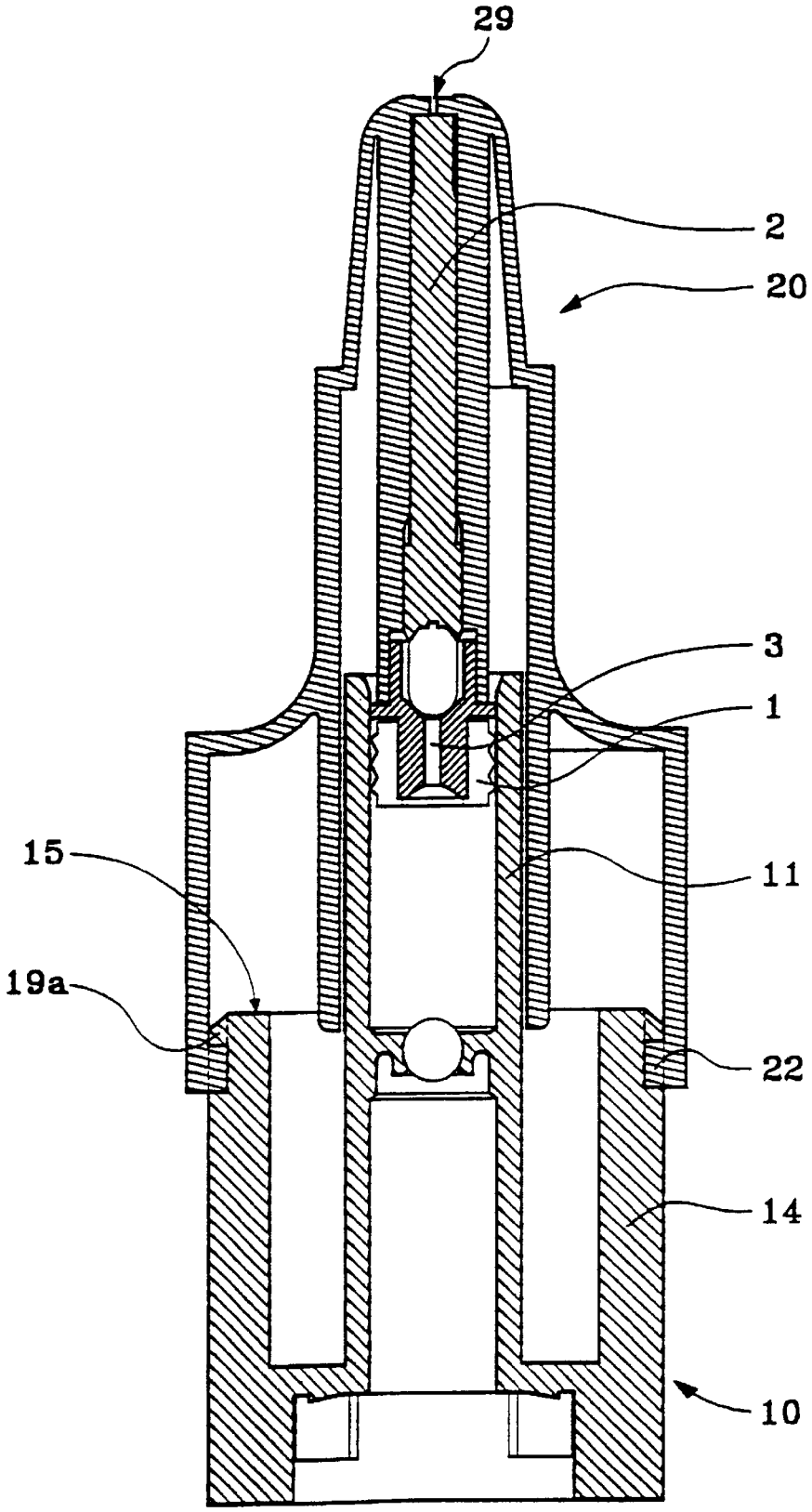
FIG. 1 is a diagrammatic vertical section view through a device constituting a preferred embodiment of the present invention, shown in its rest position.
Figure 2:
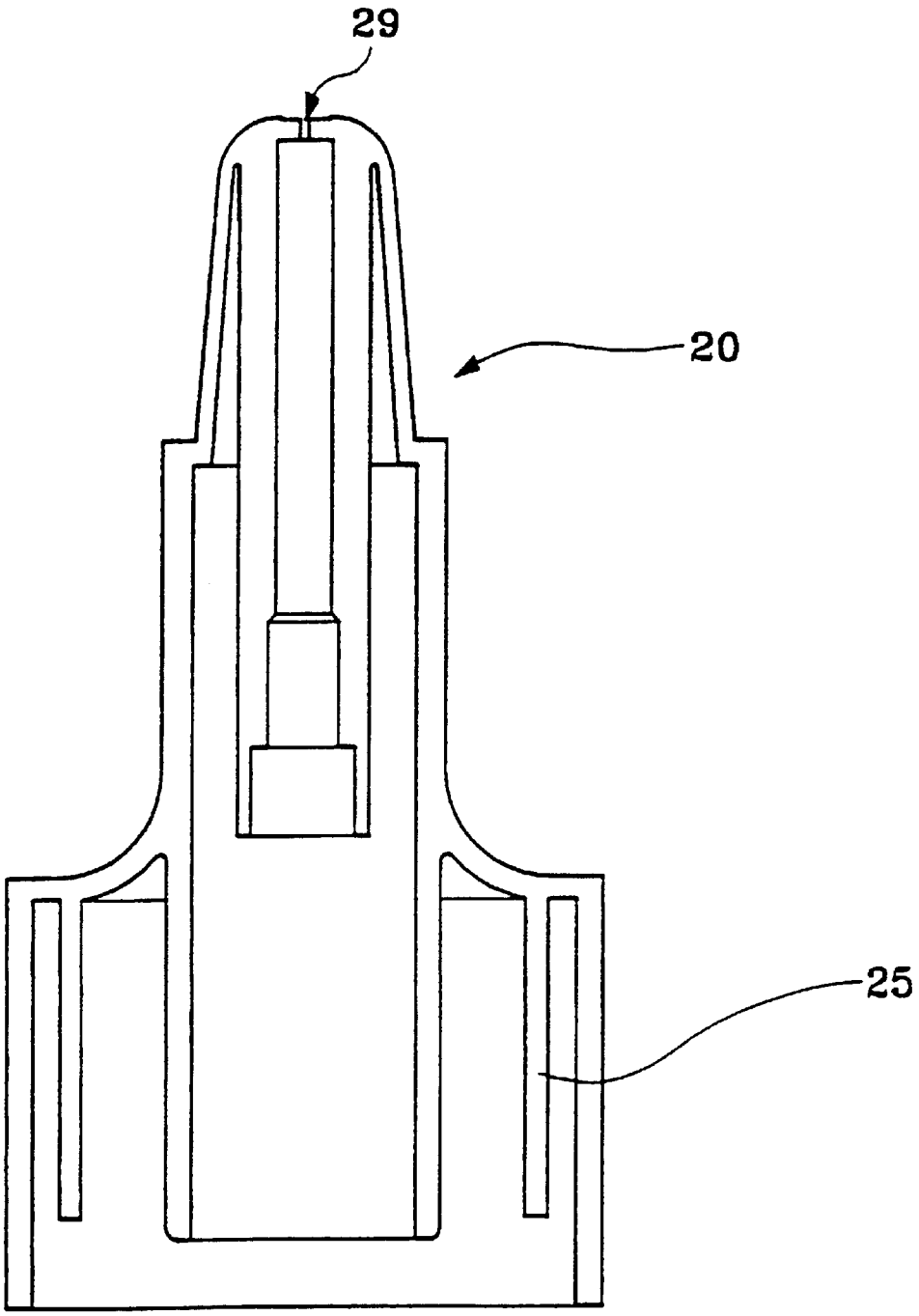
FIG. 2 is a diagrammatic vertical section view of the actuator element, showing its axial tabs.

With reference to FIGS. 1 to 3, the dispenser device of the invention comprises a tank 11 containing a fluid to be dispensed that is mounted on a base 14, a dispenser member such as a pump, and a manual actuator member 20 such as a pusher for actuating the dispenser member for the purpose of dispensing the fluid, said actuator element 20 being provided with an outlet orifice 29 through which said fluid is to be sprayed. The pump has a piston 1 slidably received in the tank 11, with the inside of the piston being connected to the outlet orifice 29 via an expulsion channel 3. Advantageously, a nozzle 2 is located in said expulsion channel to enhance atomization.

In accordance with the invention, the device has dose-fractioning means 16. The fractioning means are designed to fraction the content of the tank into two or more doses, thereby transforming the dispenser into a multi-dose dispenser, advantageously a two-dose dispenser, i.e. a device which dispenses two doses of fluid. The example shown in the figures relates in particular to a nose spray, which operates as a two-dose dispenser, one dose being provided for each nostril. Naturally, the invention is not limited to this particular application.

To guarantee perfect atomization of an entire dose of fluid, the invention provides for energy-accumulator means 12 which co-operate with the actuator element 20 during actuation of the spray device to accumulate energy in the hand of the user. Advantageously, said energy-accumulator means co-operate with said actuator element 20 in that they deform it elastically when a predetermined minimum force is exerted thereon.

According to a characteristic of the present invention, said base 14, said energy-accumulator means 12, and said dose-fractioning means 16 are implemented in the form of a single one-piece block 10. This implementation makes it possible to reduce the number of component parts and thus the cost of fabricating and assembling the dispenser device. In particular, compared with the device disclosed in document WO 93/02804, fabrication and assembly of the device are simplified since it is no longer necessary to provide moving means (split rings) for accumulating energy. The reliability of the device is also improved, since a split ring can break or jam while the device is being actuated.

As shown in the figures, the tank 11 is preferably also integrally formed with the single-piece block 10 which preferably includes two concentric hollow cylinders: the inner cylinder defines the tank 11, while the outer cylinder forms the base 14 that has said energy-accumulator means 12 on its outer surface. The two concentric cylinders are preferably interconnected by a substantially horizontal annular flange level with their bottom ends, thus defining an annular hollow space between the inner surface of the base 14 and the outer surface of the tank 11.

In the preferred embodiment of the present invention, which combines all of the advantages provided by the invention, the device also has indexing means 15 in addition to the energy-accumulator means 12 and the dose-fractioning means 16. The indexing means are intended selectively to prevent or allow actuation of the device, specifically for guaranteeing safety against undesired actuation, e.g. during transport.

In an advantageous feature of the invention, said indexing means are integrally formed with the one-piece block 10, as can be seen in particular in FIG. 9. In particular, these indexing means are made in the form of one or more thickenings 15 provided on the inner surface of the base 14, said thickenings extending over a portion of the periphery of said inner surface. They co-operate with the actuator element 20 selectively to prevent or allow axial displacement of said actuator member 20 relative to said one-piece block 10. More particularly, said thickenings 15 co-operate with one or more tabs 25 projecting inside the actuator element 20, preferably axially, and coming into abutment against said thickenings 15 in the rest position in which actuation is prevented. In this first position of the actuator element, as shown in particular in FIGS. 1 and 3*a,* any force exerted on the actuator element 20 will have no effect, and no fluid will be dispensed by the device.

To keep the actuator element 20 attached to said one-piece block 10, fastening means 19 are advantageously provided on said one-piece block 10, advantageously on the top peripheral edge of the base 14. These fastening means 19 can co-operate with one or more shoulders 22 provided on the bottom peripheral edge of the actuator elements 20. As can be seen in particular in FIG. 9, these fastening means 19, e.g. in the first position of the actuator element 20, i.e. in the rest position where actuation of the device is prevented, may have a special shape 19*a* that facilitates fastening of the actuator element 20 on the base 14 during assembly. This particular shape may, for example, be implemented in the form of a ramp 19*a* which enables the actuator element 20 to deform progressively and elastically at shoulders 22, said shoulders 22 subsequently snap-fastening beneath said fastening means 19. This particular shape 19*a* for the fastening means 19 preferably defines the position in which the actuator element 20 is mounted on the one-piece block 10, which position advantageously corresponds to said first position of the actuator element.

In accordance with the invention, the actuator element 20 is preferably mounted to rotate on the one-piece block 10. Thus, when the user desires to dispense the fluid, it is necessary to turn the actuator element 20 relative to the one-piece block 10 about its main axis towards a second position for the actuator element 20, referred to as the "ready" position, in which the indexing means 15 no longer co-operate with the actuator element 20. In other words, in this second position of the actuator element 20, shown in particular in FIG. 3*b,* the tabs 25 provided inside the actuator element 20 do not rest against the thickenings 15 of the one-piece block 10, such that actuation is no longer prevented. Advantageously, the one-piece block 10 has, on its outer surface: first rotary abutment means 18*a* for defining the direction of rotation between the first and second positions; and second rotary abutment means 18*b* for defining the second position of the actuator element 20. In particular, the rotary abutment means can be embodied by projections which project from the outer surface of the one-piece block 10 and which co-operate with said shoulders 22 of the actuator element 20 during rotation thereof.

Advantageously, the energy-accumulator means are embodied in the form of one or more studs 12, and in particular in the form of two diametrically-opposite studs, that are disposed on the outer surface of the single-piece block 10. As can be seen in FIG. 3*b,* said studs 12 co-operate with the shoulders 22 of the actuator element 20 and give rise to a certain amount of resistance against axial displacement of the actuator element 20 relative to the one-piece block 10. Thus, when the user seeks to spray a dose, the user exerts a force on the device which urges the actuator element 20 in axial displacement on the one-piece block 10, with said displacement being prevented by the studs 12. Nevertheless, since the actuator element 20 is preferably made of an appropriate plastics material, it can be deform elastically, thus enabling said shoulders 22 to pass over said studs once a predetermined minimum force is exerted on the device. This threshold corresponding to said minimum force thus enables energy to be accumulated in the hand of the user, and when the shoulders 22 of the actuator element 20 pass over the studs 12 of the one-piece block, all of said energy accumulated in the hand of the user is transmitted suddenly to the device, such that the entire dose is sprayed. There is no danger of traveling over only part of a stroke, which would have the consequence of dispensing part of a dose only.

The preferred embodiment as shown in the drawings corresponds to a two-dose dispenser. In this case, the device has fractioning means 16 designed to fraction the content of the tank 11 into two that are preferably equal doses. In the present invention, said fractioning means 16 are made integrally with the one-piece block 10. Advantageously, said fractioning means are formed by one or more thickenings 16 which, in association with the thickenings 15 acting as indexing means, constitute at least one step in the axial direction. These second thickenings 16 extend over a second portion of the inner surface of the base 14 in line with the first thickenings 15, and thus, at the end of the first dose being expelled, the second thickenings 16 co-operate with said tabs 25 of the actuator element 20 to stop the axial displacement of the actuator element 20 relative to the one-piece block 10. Said fractioning means 16 also act under such circumstances as second indexing means, given that in the ready position and after the first dose has been dispensed, they prevent the second dose being dispensed. A particularly advantageous embodiment is performed by two diametrically-opposite thickenings which, over a portion 15, extend to the peripheral top edge of the base 14 so as to form the first indexing means, and over a second portion 16, extend only about halfway up the hollow annular gap between the base 14 and the tank 11 so as to form fractioning means that also act as second indexing means. At least a portion of said inner surface must be free of thickening so as to allow the actuator element 20 to move for the purpose of dispensing the second dose. In a manner similar to that described above, in order to be able to dispense the second dose, the actuator element 20 is rotated on the one-piece block 10 into a third position where the tabs 25 no longer co-operate with the second thickenings 16, thereby permitting the second dose to be dispensed.

Advantageously, provision is also made for second energy-accumulator means 13, preferably likewise implemented in the form of studs projecting from the outer surface of the single-piece block 10, two studs 13 advantageously being likewise diametrically-opposite each other. Similarly, it is also advantageous to provide third rotary abutment means 18*c* which serve to define said third position of the actuator element 20, and which are advantageously made in a manner similar to the first and second rotary abutment means 18*a* and 18*b*. Thus, in the third position of the actuator element 20, the shoulders 22 of the actuator element 20 co-operate with the studs 13 which operate in the same manner as the above-described studs to accumulate energy in the hand of the user during dispensing of the second dose. As can be seen in particular in FIGS. 4, 5, and 6, said first energy-accumulator means 12 and said second energy-accumulator means 13 formed by respective diametrically-opposite pairs of studs, are made in such a manner that the two pairs of studs are offset axially and angularly relative to each other on the outer surface of the base. In this manner, in order to actuate the device, the user initially turns the actuator element 20 from its first position where actuation is prevented into its second position, and then the user dispenses the first dose, after which the actuator element is turned again from its second position to its third position, thereby allowing the device to be actuated again to dispense the second dose.

A particular advantage of the energy-accumulator means disposed on the outer surface of the one-piece block 10 is provided by the fact that said studs can also act as dose-indicators. When both the studs 12 and 13 are visible, that means that no dose has yet been dispensed. When only one of the two studs is visible, that means that only the first dose has been dispensed, and when no stud is visible, that means that both doses have been dispensed.

Thus, in the preferred embodiment of the invention as shown in the drawings, the one-piece block 10 incorporates the base, the tank, the energy-accumulator means, the indexing means, the dose-fractioning means, the rotary abutment means defining the angular positions of the actuator element, and the fastening means for holding the actuator element on the one-piece block. The present invention thus makes it possible to make a saving of several component parts for the device. Because the energy-accumulator means are not provided in the hollow annular gap defined between the base and the tank, but on the contrary are provided on the outer surface of the base, said one-piece block can be made in simple and cheap manner, e.g. by molding. In particular, whether in the above-described preferred configuration or in any other configuration covered by the present invention, the component parts of the device can all be made by means of molds that are simple and of low cost since they do not include any undercuts. Assembly of the device is also greatly facilitated because of the small number of parts. Fabrication and assembly costs of the device of the invention are thus particularly low, but without that affecting its reliability in operation.

Although the invention is described above with reference to the preferred embodiment which constitutes a two-dose dispenser, the present invention naturally also applies to multi-dose dispensers that deliver more than two doses, and in which case the fractioning means and the energy-accumulator means can be provided several times over. Similarly, the tank 11 need not form an integral portion of the one-piece block, but it can be fixed thereto, e.g. by snap-fastening. The inside of the tank 11 can also be provided with a cylinder of glass or of any other suitable material for the purpose of improving sealing.

What is claimed is:

1. A device for spraying fluid, the device comprising a tank (11) containing a plurality of doses of fluid; a cylindrical base (14) receiving tank (11); a dispenser member such as a pump, a manual actuator element (20); fractioning means (16) co-operating with said actuator element (20) to fraction the content of the tank (11) into at least two doses; and energy-accumulator means (12) co-operating, during actuation, with said manual actuator element (20) to resist, up to a minimum threshold force, actuation of said actuation element by a user applying an actuation force, so that when said minimum threshold force is exceeded, the actuation force is suddenly translated into movement of said actuator element so as to guarantee proper atomization of the entire dose of fluid on each actuation, and wherein said base (14), said fractioning means (16), and said energy-accumulator means (12) form integral portions of a common one-piece block (10).

2. A device according to claim 1, in which said tank (11) is integrally formed with said one-piece block (10).

3. A device according to claim 1, further comprising indexing means (15) co-operating with said manual actuator element (20) selectively to allow or prevent actuation of the device, in which said indexing means (15) are integrally formed with said one-piece block (10).

4. A device according to claim 3, in which said indexing means are formed by one or more thickenings (15) provided on a portion of an inner surface of said one-piece block (10) and co-operating, in a first position of the actuator element (20), with one or more tabs (25) projecting into an inside of the actuator element (20) to prevent actuation of the device, said actuator element (20) being movable in rotation relative to said one-piece block (10) into a second position in which said tabs (25) no longer co-operate with said thickenings (15), thereby enabling the device to be actuated.

5. A device according to claim 1, in which said energy-accumulator means (12) co-operates with said element (20) by deforming said actuator element elastically when the minimum threshold force is exerted thereon.

6. A device according to claim 5, in which said energy-accumulator means are studs (12) formed on an outer surface of said one-piece block (10), which studs co-operate with corresponding shoulders (22) provided on an inner surface of the actuator element (20).

7. A device according to claim 3, in which said fractioning means are formed by thickenings (16) forming at least one axially-directed step with the thickenings (15) acting as indexing means.

8. A device according to claim 1, in which the device is a two-dose dispenser adapted to dispense two doses of fluid, said actuator element (20) being rotatably mounted on said one-piece block (10), wherein said one-piece block comprises:

first indexing means formed by one or more thickenings (15) extending over a first portion of an inner peripheral surface of the base (14) and co-operating, in a first position of the actuator element (20), with one or more axial tabs (25) projecting into the actuator element (20) to prevent a first dose of the two doses from being dispensed;

said energy-accumulator means, which is a first energy-accumulator means (12), formed by one or more studs (12) projecting from an outer surface of said base (14) and co-operating, after a first rotation of the actuator element (20) into a second position in which said first indexing means (15) no longer co-operate with the actuator element (20), with one or more shoulders (22) provided on an inner surface of the actuator element (20), thereby accumulating energy in a hand of the user during actuation of the device, said shoulders (22) passing over said studs (12) only after the minimum threshold force has been applied, thereby enabling the actuator element (20) to move relative to the one-piece block (10), and thus to cause the first dose to be dispensed;

fractioning means formed by one or more thickenings (16) extending over a second portion of the inner peripheral surface of the base (14) and co-operating with said axial tab(s) (25) of the actuator element (20) after the first dose has been dispensed to prevent additional axial displacement of the actuator element (20) over the one-piece block (10), thereby fractioning the content of the tank (11) into the two doses, such that said fractioning means (16) act simultaneously as second indexing means; and second energy-accumulator means (13) formed by one or more studs (13) projecting from the outer surface of the base (14) and co-operating, after a second rotation of the actuator element (20) into a third position in which said second indexing means (16) no longer co-operate with the actuator element (20), with said shoulder(s) (22) of the actuator element (20), to accumulate energy in the hand of the user, allowing the second dose to be dispensed only after a predetermined minimum threshold force has been applied.

9. A device according to claim 8, in which each of said first and second energy-accumulator means comprises a pair of diametrically-opposite projecting studs (12, 13), the two pairs of studs (12, 13) being axially and circumferentially offset relative to each other on the outer surface of said one-piece block (10).

10. A device according to claim 8, in which, in said first position of the actuator element (20), said shoulder(s) (22) of the actuator element (20) co-operate, e.g. by snap-fastening, with fastening means (19) provided on the top peripheral edge of said one-piece piece (10) to hold said actuator element (20) on said one-piece block (10).

11. A device according to claim 8, in which said one-piece block (10) includes, on an outer surface: first rotary abutment means **(18*a*) co-operating with said actuator element (20) to define said first position of the actuator element; and second rotary abutment means (18*b*) co-operating with the actuator element (20) to define said second position of the actuator element; and third rotary abutment means (18*c*) co-operating with the actuator element (20)** to define said third position of the actuator element.

12. A device for spraying fluid, comprising:

a tank containing a plurality of doses of fluid;

a base incorporating said tank;

a pump actuated by a manual actuator element, said manual actuator element having shoulder portions;

a fractioning element that co-operates with said actuator element to fraction the content of the tank into at least two doses; and energy-accumulator studs that co-operate, during actuation, with said shoulder portions of said manual actuator element to resist, up to a minimum threshold force, actuation of said actuation element by a user applying an actuation force, so that when said minimum threshold force is exceeded, the actuation force is suddenly translated into axial movement of said actuator element so as to guarantee proper atomization of an entire single dose of fluid upon actuation.

13. The device according to claim 12, wherein said energy-accumulator studs are formed on an outer of said base, and wherein said shoulder portions are formed on an inner surface of said manual actuator element, and wherein a portion of said manual actuator element along said inner surface of said manual actuator element slides axially over a portion of said base along said outer surface of said base upon actuation of said pump.

14. The device according to claim 13, wherein said base, said fractioning element, and said energy-accumulator studs are integrally formed portions of a common one-piece block.

15. The device according to claim 13, wherein said energy-accumulator studs co-operate with said shoulder portions to elastically deform said actuator element elastically when the minimum threshold force is exerted thereon.

* * * * *